United States Patent [19]

Takada et al.

[11] Patent Number: 4,939,550

[45] Date of Patent: Jul. 3, 1990

[54] TRANSFER PAPER GUIDE DEVICE FOR AN ELECTROSTATIC PHOTOGRAPHIC APPARATUS

[75] Inventors: Hiromi Takada, Yokohama; Toshio Shimazaki, Tokyo; Keiji Okamoto; Hideo Aoki, both of Yokohama, all of Japan

[73] Assignee: Ricoh Company, Ltd., Tokyo, Japan

[21] Appl. No.: 195,502

[22] Filed: May 17, 1988

[30] Foreign Application Priority Data

May 18, 1987 [JP] Japan ..... 62-119120

[51] Int. Cl.[5] ..... G03G 15/20; G03G 21/00

[52] U.S. Cl. ..... 355/282; 355/290; 355/309; 271/900

[58] Field of Search ..... 355/271, 274, 276, 277, 355/282, 289, 290, 295, 309, 315; 271/161, 188, 275, 307, DIG. 900

[56] References Cited

U.S. PATENT DOCUMENTS

| | | | |
|---|---|---|---|
| 3,774,907 | 11/1973 | Borostyan | 271/900 X |
| 3,914,041 | 10/1975 | Opravil | 271/900 X |
| 4,752,801 | 6/1988 | Kando | 355/290 X |

*Primary Examiner*—A. T. Grimley
*Assistant Examiner*—E. Pipala
*Attorney, Agent, or Firm*—Oblon, Spivak, McClelland, Maier & Neustadt

[57] ABSTRACT

An electrostatic photographic apparatus includes a photosensitive drum and a fixing device composed of a pair of rollers pressure-contacted with each other over a predetermined nip width, in which a toner image formed on the photosensitive drum is transferred onto a lower surface of a transfer paper transported over an upper portion of the photosensitive drum while contacting therewith and is fixed by a nip portion of the rollers of the fixing device, an inlet end of the nip portion is disposed on a curve of a cross section of the transfer paper when the latter is warped with a radius of curvature smaller than a radius of curvature of cross section of a transfer paper having stiffness smallest among other transfer papers usable in the apparatus when the transfer paper of the smallest stiffness is supported at its rear end horizontally at a point at which the transfer paper leaves the photosensitve drum while allowing the other portion thereof to be drooped freely by gravity, a tangential line of the rollers at a center of the nip portion being substantially coincident with a tangential line of the curve, and guide member having a lower guide surface convexed upwardly is arranged along the curve between the separating point of the transfer paper from the photosensitive drum and the inlet end of the nip portion.

3 Claims, 4 Drawing Sheets

TRANSFER PAPER GUIDE DEVICE FOR AN ELECTROSTATIC PHOTOGRAPHIC APPARATUS

FIELD OF THE INVENTION AND RELATED ART STATEMENT

The present invention relates to an electrostatic photographic apparatus in which an optical writing of an image information signal onto a photosensitive drum with a light corresponding thereto through an optical write device.

In an electrostatic photographic apparatus such as laser printer or facsimile machine, a record of an image information is performed by optically writing it on a photosensitive member through an optical write unit by laser beam which is intensity-controlled or modulated with an image information signal, transferring a toner image obtained by developing, under an effect of a transfer charger, a resultant latent image formed on the photosenstive member by means of a developing unit onto a transfer paper supplied by an automatic paper feeder unit and fixing it.

In such recording apparatus as mentioned above, heretofore, the optical write unit is disposed above the photosensitive member and optically writes the information in a position above the photosensitive member. After the image is developed, it is transferred onto the transfer paper with a transfer surface side up fed through a transfer portion between the transfer charger provided below the photosenitive member and the latter.

Therefore the paper feeder portion protrudes on a side of the developing unit or, when it is provided below the transfer charger, it is aranged in a space large enough to U-turn the transfer paper therein. Thus, the apparatus itself is large in size. In a case where the transfer paper jammed within the transfer portion or a feeding passage thereof is to be removed, it is necessary to open the entire photosentive drum unit including the optical writing unit, the developing unit and the photosensitive member, which is troublesome.

The present inventors had proposed an image recording apparatus which is compact in size and in which the removal of jammed paper is facilitated.

FIG. 5 shows an example of a laser printer based on the proposal of the present inventors. In FIG. 5, an optical write unit 7 is disposed below a photosentitive drum 1, a charger 2, a developing unit 3 and a cleaning unit 5 and an automatic feeder unit 8 is below the optical write unit 7. A transfer charger 4 is disposed above the photosensitive drum 1. The transfer paper is fed to the transfer portion with the image side thereof down and, after a transfer completes, it is separated from the photosensitive drum and transported to a thermal roller type fixing device 9 where it is fixed. A potion 10 of an upper cover of the apparatus is openable and the transfer charger 4 and an upper roller 11 of a register pair 11 and 12 are provided integrally on the cover portion 10.

Therefore, the transfer paper fed out from the paper feeder unit 8 can be sent into the register roller pair 11 and 12 after passing through an outside of the developing unit 3 without necessity of large space, resulting in the apparatus being compact in size. When the transfer paper is jammed in the transfer portion or the register roller pair 11, 12, it is enough to open the upper cover portion 10 and remove it, since the transfer charger 4 and upper roller 11 of the register roller pair 11, 12 can be lifted up together with the cover portion 10.

In this apparatus, however, the toner image is transferred to a lower surface of the transfer paper and the latter is transported to a nip portion of the fixing rollers while carrying the non-fixed toner image on the lower surface. Therefore, if the transfer paper is warped downwarly during the transportation, the non-fixed toner image may contact with some members arranged beneath the transfer paper, causing a degradation of the resultant image.

OBJECT AND SUMMARY OF THE INVENTION

In view of the above mentioned problems of the electrostatic photographic apparatus in which a toner image is transferred to a lower surface of a transfer paper passing above a photosensitive drum, an object of the present invention is to provide an electrostatic photographic apparatus capable of preventing a toner image on an image surface of a transfer paper from being degraded due to an undesired contact thereof with other members disposed beneath it, during a transportation thereof from a transfer portion to a fixing portion of the apparatus.

In order to achieve the above object, according to the present invention, an electrostatic photographic apparatus includes a photosensitive drum and a fixing device composed of a pair of rollers pressure-contacted with each other over a predetermined nip width, in which a toner image formed on the photosensitive drum is transferred onto a lower surface of a transfer paper transported over an upper portion of the photosentsitive drum while contacting therewith and is fixed by a nip portion of the rollers of the fixing device, an inlet end of the nip portion is disposed on a curve of a cross section of the transfer paper when the latter is warped with a radius of curvature smaller than a radius of curvature of cross section of a transfer paper having stiffness smallest among other transfer papers usable in the apparatus when the transfer paper of the smallest stiffness is supported at its rear end horizontally at a point at which a transfer paper leaves the photosensitive drum while allowing the other portion thereof to be dropped freely by gravity, a tangential line of the rollers at a center of the nip portion being substantially coincident with a tangential line of the curve, and a guide member having a lower guide surface convexed upwardly is arranged along the curve between the separating point of the transfer paper from the photosensitive drum and the inlet end of the nip portion

DETAILED DECSRIPTION OF PREFERRED EMBODIMENTS

Figure 6:
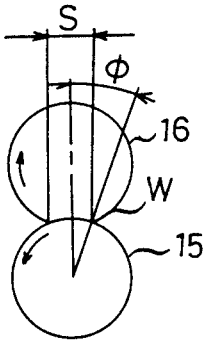
FIGS. 6 and 7 illustrate examples of a nip portion of a thermal roller type fixing device, respectively.

The thermal roller type fixing device which is used widely as the fixing device of an electrostatic photographic apparatus comprises a fixing roller 15 having a heat source and a pressure roller 16 in pressure contact with the roller 15, as shown in FIG. 6, in which a transfer paper having a non-fixed toner image is inserted into a nip portion thereof and the toner image is fixed on the transfer paper by heating the latter and toner by the heat source thereof. In order to obtain a time long enough to heat them to a sufficient temperature, an outer surface layer of the pressure roller 16 is of rubber and a constant nip width S is formed by a pressure contact of the fixing roller 15 with the pressure roller 16 at a predetermined pressure. The transfer paper is inserted from an end W of the nip portion on the side of the photosensitive drum thereinto and transported therethrough while pinched between the rollers 15 and 16.

Figure 7:
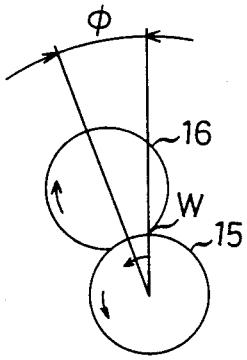

The end W on a periphery of the fixing roller 15 is behind a line passing through centers of the rollers 15 and 16 by an angle of $\phi$ as shown in FIG. 6. In other words, the line passing through the centers of the rollers 15 and 16 is tilted forwardly with respect to a line passing through the center of the roller 15 and the point W by $\phi$, as shown in FIG. 7. The angle $\phi$ is a central angle with respect to a half the nip width S of the peripheral surface of the fixing roller.

Figure 1:
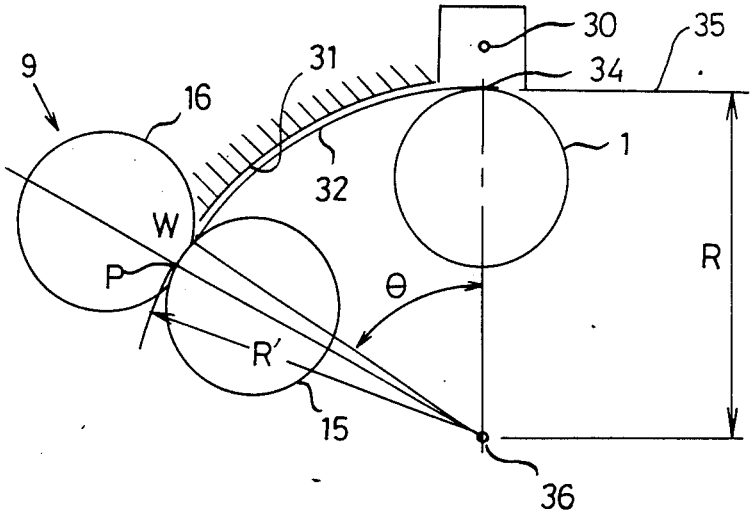
FIGS. 1 to 4 illustrate a photosensitive drum, a fixing roller and a transfer paper guide member according to the present invention and positional relationships thereof, respectively.

FIG. 1 shows a portion of the laser printer including a photosensitive member 1 and a fixing device 9, to which the present invention is applied.

An end portion W of an inlet of a nip portion composed of a fixing roller 15 and a pressure roller 16 is below a tangential line 35 with respect to a photosensitive drum 1 at a transfer position 34 thereon. In this embodiment, a position of the inlet end portion W of the nip between the fixing roller pair is set such that the transfer position 34 is above a normal line passing through a center of the photosensitive drum 1, and a center point 36 is supposed which in below the transfer position 34 by a radius of curvature R smaller than that of a transfer paper whose stiffness is minimum which can be used in this apparatus when a rear edge thereof is supported horizontally at the point 34 with other portion thereof being allowed to droop freely. The rollers 15 and 16 are arranged such that the inlet end W of the nip portion between rollers 15 and 16 is set at an end point of arc of a radius R with the point 36 being a center, which is separated from the transfer position 34 by an angle of $\theta$ and that a line passing through the center of the rollers 15 and 16 passes through the point 36.

The transfer paper 32 having drooping radius R passes along the arc after a transfer, and is inserted into the inlet end W of the nip portion between the rollers 15 and 16 substantially tangentially thereof. For a transfer paper whose stiffness is higher, a guide 31 is provided which has lower edge concordant with the aforementioned arc. The transfer paper is inserted into the nip portion while sliding along the guide 31. Therefore, the transfer paper carrying a non-fixed toner image on its lower surface is never drooped and transported from the transfer portion to the inlet portion W of the nip of the fixing portion without the toner image being abraded by other members, resulting in a high quality image.

Figure 5:
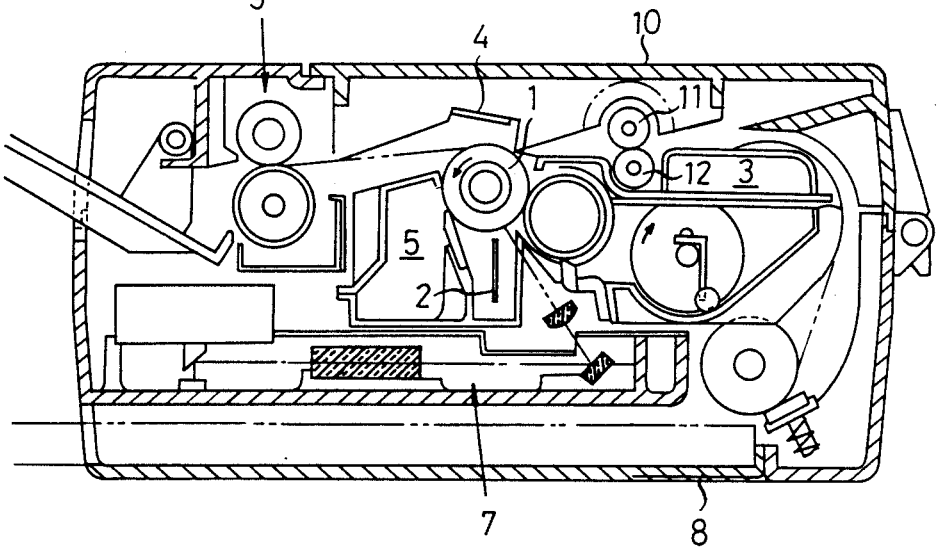
FIG. 5 is a cross section of an example of an electrostatic photographic apparatus to which the present invention is applied.

Although, in FIG. 1, the transfer charger 30 takes the form of a thin wqire corona discharger, it may be a solid state corona discharger as shown in FIG. 5.

Figure 2:
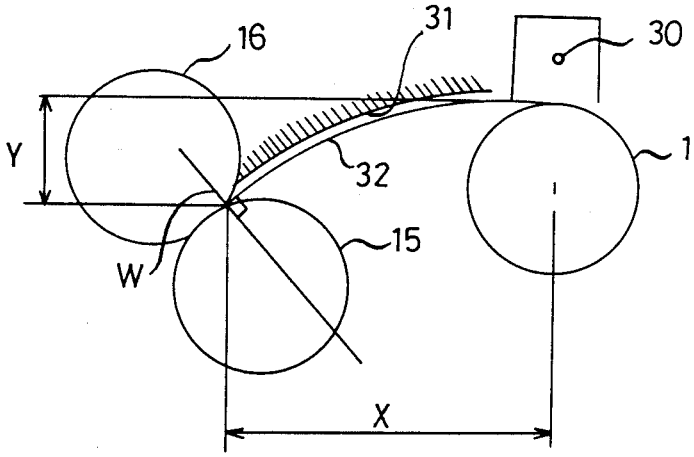

In the embodiment shown in FIG. 1, the transporting passage of the transfer paper is defined as having a radius smaller than that obtained by the transfer paper having stiffness which is smallest among transfer papers which are also usable in the present apparatus so that the transfer paper always slidingly moves along the guide 31 while being pressed thereto. However, it is possible to remove such pressing force when the transfer paper is that having the smallest stiffness. FIG. 2 shows an arrangement of the respective members in this case, in which the inlet portion W between the rollers 15 and 16 is disposed in a point (X, Y) on the passage 32 of the transfer paper which moves without guidance and a straight line passing through the centers of the rollers 15 and 16 becomes substantially parallel to the tangential line at the point (X, Y) with respect to the transfer paper passage. The guide 31 having a downward concave surface is disposed above and along the paper passage and the transfer paper moves along the guide 31 without pressure. For more stiff transfer papers, they are guided by the guide 31 while sliding therealong. Therefore, the transfer paper is always transported while warped upwardly without abrasion of the non-fixed toner image surface.

Figure 3:
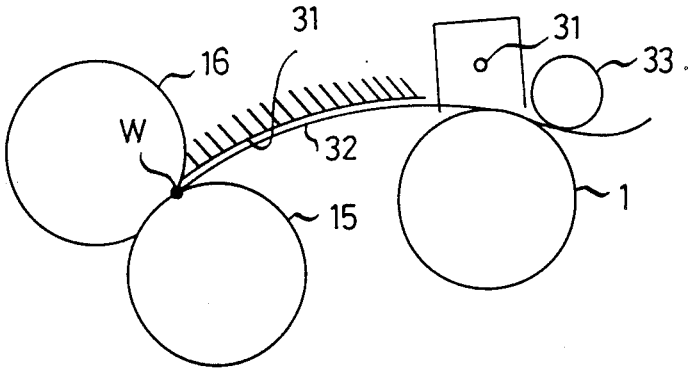

In another embodiment shown in FIG. 3, a guide 33 in the form of roll is arranged in an upstream side of the photosenstive member 1 and the transfer paper is advanced obligately upwardly when it leaves the photosensitive member 1. Thus, the transfer paper whose stiffness is low is transported without guidance along a passage 31 which is slightly either of the two cases mentioned previously. Therefore, by providing a guide 31 therealong and setting the inlet portion W of the nip portion between the fixing roller 15 and the pressure roller 16 on the passage 31, it is possible to transport paper to the fixing device while keeping the paper in an upwardly concaved state. Therefore, there is no need of substantially lowering the fixing device below the transfer position, resulting in a facilitated layout.

Figure 4:
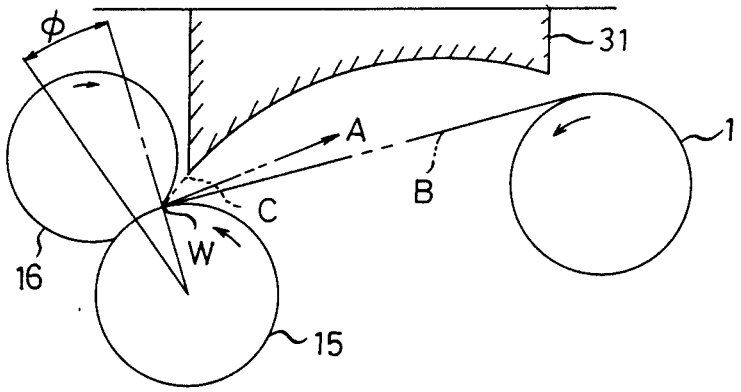

Practically, the guide 31 between the transfer portion and the fixing portion cannot be arranged in the vicinity of the inlet portion W of the nip portion between the rollers 15 and 16. Further, if the direction of the line passing through the centers of these rollers is made coincident with the tangential line of the free passage of the transfer paper having the smallest stiffness, the position of the centers of these rollers are substantially deviated horizontally, causing the size of the fixing housing to be larger. In order to solve this problem, the tangential direction A of the fixing roller 15 at the inlet W of the nip portion between the rollers 15 and 16 is made in between an upper common tangent B of the photosensitive drum 1 and the fixing roller 15 and a tangential direction C at a rear end of the guide surface of the guide 31, as shown in FIG. 4.

In either of the descibed embodiments, since the guide surface of the guide 31 is upwardly convexed and positioned above the upper common tangent of the photosensitive drum 1 and the fixing roller 15, the image surface of the transfer paper transported therealong can not be abraded by members disposed below the surface.

Figure 8:
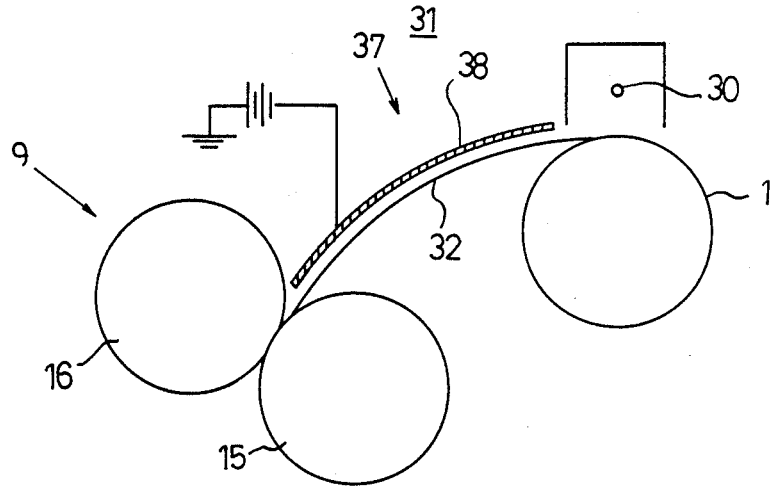
FIGS. 8 and 9 illustrate embodiments having electrostatic attraction.
Figure 9:
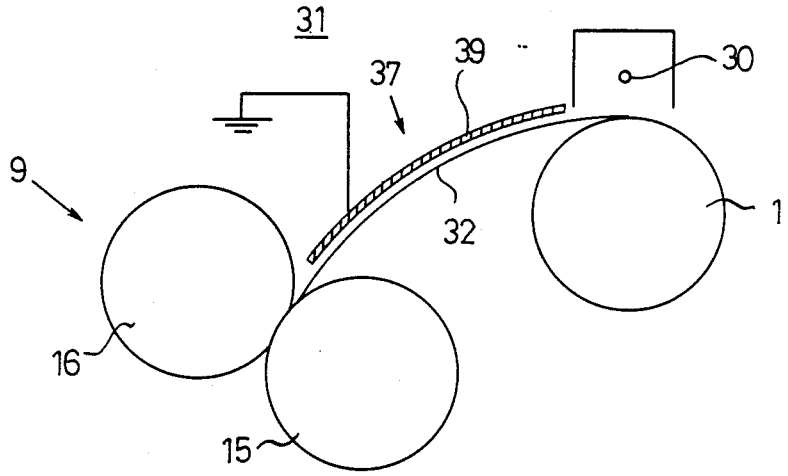

When the guide 31 in any of the embodiments comprises an electrostatic attraction device, the transfer paper moves therealong while being attracted thereby, it is possible to transport the transfer paper having the smallest stiffness without drooping and, therefore, the degradation of the image due to abrasion is avoided. The electrostatic attraction device 37 comprises for example, as shown in FIG. 8 a semiconductive sheet 38 having a surface charged to provide an attracting force. Alternatively, as shown in FIG. 9, the electrostatic attractive device 37 is of a conductive plate 39 grounded. In the latter case, the transfer paper is attracted thereto by electrostatic charge given thereon by the transfer charger.

Since, as shown in Fig. 1, a difference between the distance R' between the point 36 and a cross point P (a center of the nip in width direction) of the line passing through the centers of the rollers 15 and 16 and a pressure contact plain of the rollers 15 and 16 and the distance R between the point 36 and the inlet end W of the nip portion is very small for the nip width of the thermal roller fixing device which is usually ulitized, the point W in the foregoing description may be substituted by the point P, practically.

What is claimed is:

1. An electrostatic photographic apparatus having a photosensitive drum, a fixing device composed of a pair of rollers in pressure-contact with each other over a predetermined nip width, and a guide member having a guide surface extending so as to slidably engage and guide an upper surface of a transfer paper between a separation point of said transfer paper from said photosensitive drum and inlet end of said nip of said pair of rollers of the fixing device, said transfer paper having a toner image transferred onto a lower surface thereof from said photosensitive drum and being separated therefrom at said separation point to be sent off horizontally, said separation point being above said nip portion, wherein said guide surface of said guide member is formed into circular arc having a radius of curvature smaller than a radius of curvature formed by a transfer paper having smallest stiffness among the paper which may be used for said electrostatic photographic apparatus when the transfer paper is being supported horizontally at said separation point on said photosensitive drum, wherein a tangential line of said guide surface at an end thereof closest to said photosensitive drum is horizontal, and wherein a tangential line of said guide surface at an end thereof closest to said fixing device is substantially coincident with a tangential line of said rollers at a center of said nip portion.

2. An electrostatic photographic apparatus as claimed in claim 1, wherein a tangential line of said guide surface at an end thereof closest to said fixing device is coincident with a tangenial line at an inlet end of said nip portion.

3. The electrostatic photographic apparatus as claimed in claim 1, wherein said guide member includes an electrostatic attraction means for electrostatically attracting said transfer paper onto said guide surface thereof.

* * * * *